US010898775B2

(12) United States Patent
Poetter

(10) Patent No.: US 10,898,775 B2
(45) Date of Patent: Jan. 26, 2021

(54) INTERCHANGEABLE GAMEBOARDS

(71) Applicant: Brian Edmund Poetter, Merrillville, IN (US)

(72) Inventor: Brian Edmund Poetter, Merrillville, IN (US)

( * ) Notice: Subject to any disclaimer, the term of this patent is extended or adjusted under 35 U.S.C. 154(b) by 0 days.

(21) Appl. No.: 16/553,175

(22) Filed: Aug. 28, 2019

(65) Prior Publication Data

US 2020/0001158 A1 Jan. 2, 2020

Related U.S. Application Data

(63) Continuation-in-part of application No. 15/162,695, filed on May 24, 2016, now Pat. No. 10,603,560.

(51) Int. Cl.
*A63B 67/06* (2006.01)

(52) U.S. Cl.
CPC ..... *A63B 67/06* (2013.01)

(58) Field of Classification Search
CPC ..... A63B 67/06; A63B 63/00
See application file for complete search history.

(56) References Cited

U.S. PATENT DOCUMENTS 3,235,118 A * 2/1966 Kewley ..... B65D 9/32 217/65
2013/0082442 A1* 4/2013 Hanel ..... A63B 63/00 273/398

OTHER PUBLICATIONS https://www.craftsy.com/blog/2014/11/how-to-make-a-wooden-box-with-a-sliding-lid/ Author: Wilbur Pan; Date: Nov. 15, 2014 (Year: 2014).*

* cited by examiner

*Primary Examiner* — Jeffrey S Vanderveen
(74) *Attorney, Agent, or Firm* — Christopher Mayle; Thomas E. LaGrandeur; Bold IP, PLLC

(57) ABSTRACT

A cornhole game board providing an interchangeable faceplate display is provided. The game board includes a framework having a plurality of peripheral elements defining an opening into which a faceplate may be inserted. Each peripheral element may define a portion of a coplanar slot extending along the game board framework, wherein one of a plurality of faceplates may be slidably received or removed in the resulting coplanar slot. Thereby the game board provides a variety of interchangeable playing surfaces of cornhole.

20 Claims, 5 Drawing Sheets

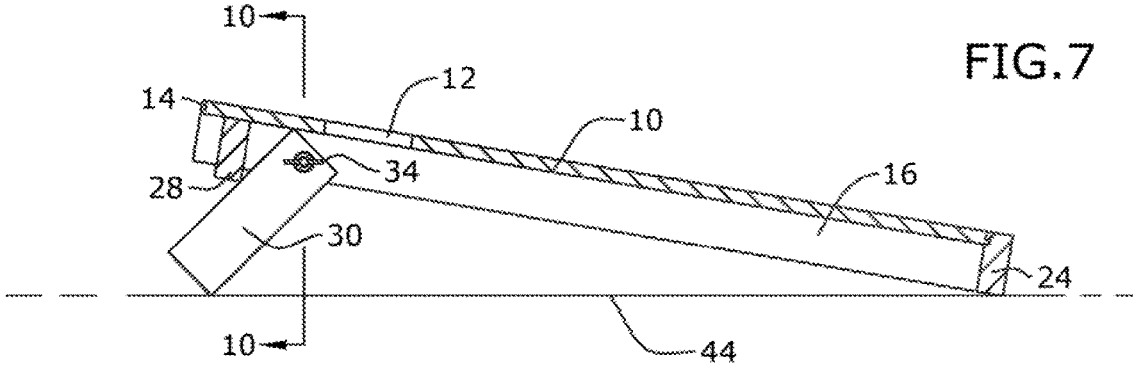
FIG.7
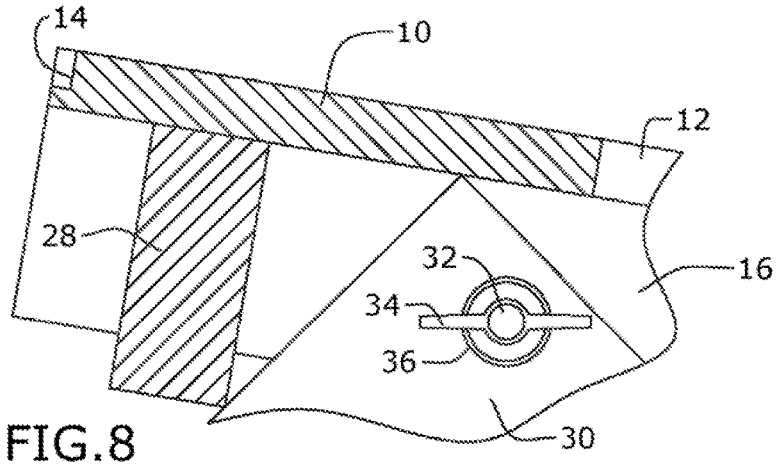
FIG.8
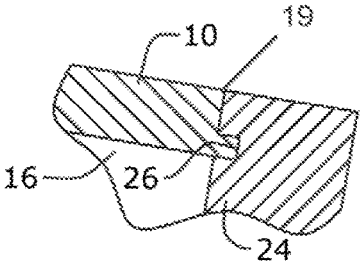
FIG.9
FIG.10
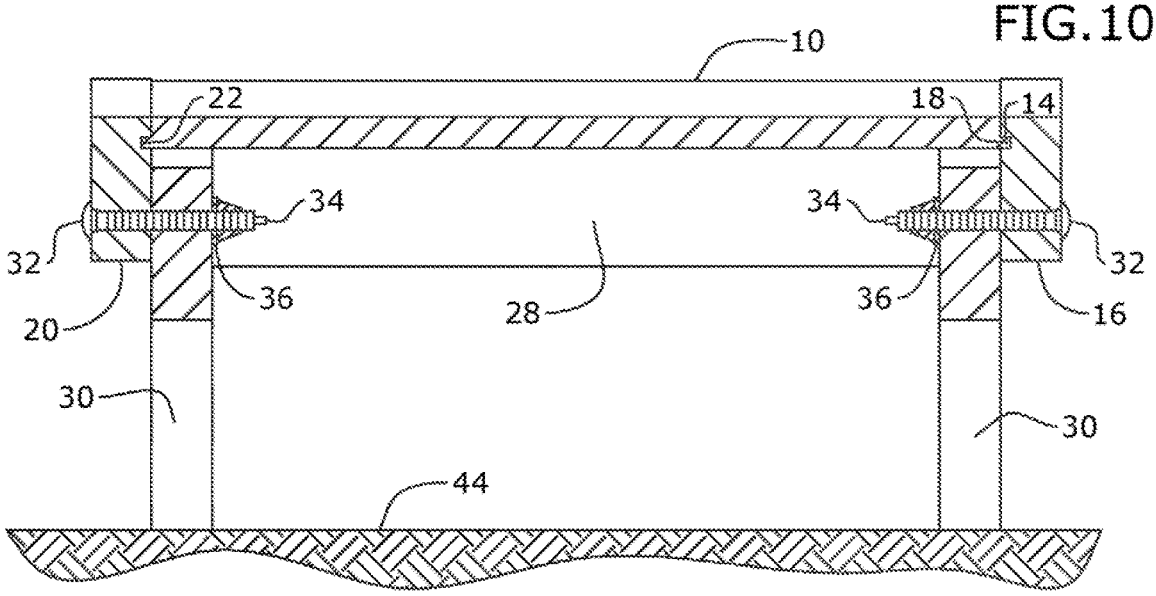

INTERCHANGEABLE GAMEBOARDS

CROSS-REFERENCE TO RELATED APPLICATIONS

This application is a continuation in part which claims priority to U.S. Non-Provisional application Ser. No. 15/162,695 filed on May 24, 2016, which is incorporated by reference in its entirety.

FIELD OF THE DISCLOSURE

The present invention relates to interchangeable game boards and, more particularly, a cornhole game board adapted to slidably receive interchangeable faceplates.

BACKGROUND

The game of cornhole, also known as dummy boards, bean bag toss, and other names is an American lawn game in which players take turns throwing bags of corn at a raised platform with a hole in the far end, scoring points for getting a bag in the hole or to land and stay on the platform. Current cornhole game boards have a static and permanent platform or "playing surface," and thus they lack the ability to change designs on the playing surface without completely deconstructing the actual board. Thus, if a playing surface becomes worn, warped, or weathered, a user cannot replace the playing surface without purchasing an entirely new game board. Similarly, if a user follows multiple teams or otherwise would like multiple designs on their playing surface, they would need to have multiple game boards, which would consume both money and storage space.

As can be seen, there is a need for a game board frame adapted to slidably receive interchangeable faceplates for providing a variety of playing surfaces, effectively utilizing only one game board frame to do so.

SUMMARY

The disclosure presented herein relates to a gameboard, comprising: two spaced apart longitudinal elements, said two spaced apart longitudinal elements each having a vertex at a first end of both longitudinal elements, a base element comprising two ends each having a vertex that are obliquely opposed to both longitudinal element's first ends, said obliquely opposed vertexes interconnecting the two longitudinal elements so as to define an opening, wherein the two base element ends are each independently connected near the respective first ends of each of the two longitudinal elements as to form two obliquely opposed vertex connections, a longitudinal slot provided by each of the two longitudinal elements so that the longitudinal slots are coplanar, a removable component configured to connect to the longitudinal slot provided by each of the two longitudinal elements, wherein said removable component is configured to prevent the movement of said faceplates when slid into the longitudinal slots, a plurality of faceplates, each of said faceplates having at least one cornhole that passes from a top surface to a bottom surface and each of said faceplates dimensioned and adapted with a dado along a first and a second side to slide into the longitudinal slots so as to be substantially visible through the opening, wherein said dado is configured to facilitate the sliding reception within the coplanar slots of said plurality of faceplates having at least one cornhole.

The disclosure presented herein relates to a gameboard, comprising, two spaced apart longitudinal elements, said two spaced apart longitudinal elements each having a 45 degree vertex at a first end of both longitudinal elements, a base element comprising two ends each having a 45 degree vertex that are obliquely opposed to both longitudinal element's first ends, said obliquely opposed vertexes interconnecting the two longitudinal elements so as to define an opening, wherein the base elements two ends are each independently connected near the respective first ends of each of the two longitudinal elements as to form two obliquely opposed vertex connections, a longitudinal slot provided by each of the two longitudinal elements so that the longitudinal slots are coplanar, a removable component configured to connect to the longitudinal slot provided by each of the two longitudinal elements, wherein said removable component is configured to prevent the movement of said faceplates when slid into the longitudinal slots, a plurality of faceplates, each of said faceplates having at least one cornhole that passes from a top surface to a bottom surface and each of said faceplates dimensioned and adapted with a dado along a first and a second side to slide into the longitudinal slots so as to be substantially visible through the opening, wherein said dado is configured to facilitate the sliding reception within the coplanar slots of said plurality of faceplates having at least one cornhole.

The disclosure presented herein relates to a method of changing a faceplate for a gameboard, the method comprising, sliding a first faceplate into two spaced apart longitudinal slots, said two spaced apart longitudinal elements each having a vertex at a first end of both longitudinal elements, wherein the first faceplate visible through an opening in the framework, the framework comprising a base element comprising two ends each having a vertex that are obliquely opposed to both longitudinal element's first ends, said obliquely opposed vertexes interconnecting the two longitudinal elements so as to define an opening, wherein the base elements two ends are each independently connected near the respective first ends of each of the two longitudinal elements as to form two obliquely opposed vertexes connections, a longitudinal slot provided by each of the two longitudinal elements so that the longitudinal slots are coplanar, a removable component configured to connect to the longitudinal slot provided by each of the two longitudinal elements, and connecting removable component to the longitudinal slot provided by each of the two longitudinal elements, wherein said removable component prevents the movement of the first faceplate.

The preceding and following embodiments and descriptions are for illustrative purposes only and are not intended to limit the scope of this disclosure. Other aspects and advantages of this disclosure will become apparent from the following detailed description.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

FIG. 7 is a section view of an embodiment of the present invention, taken along 7-7 in FIG. 1;

FIG. 8 is an enlarged section view of an embodiment of the present invention;

FIG. 9 is an enlarged section view of an embodiment of the present invention; and FIG. 10 is a section view of an embodiment of the present invention, taken along 10-10 in FIG. 7.

DETAILED DESCRIPTION

Figure 1:
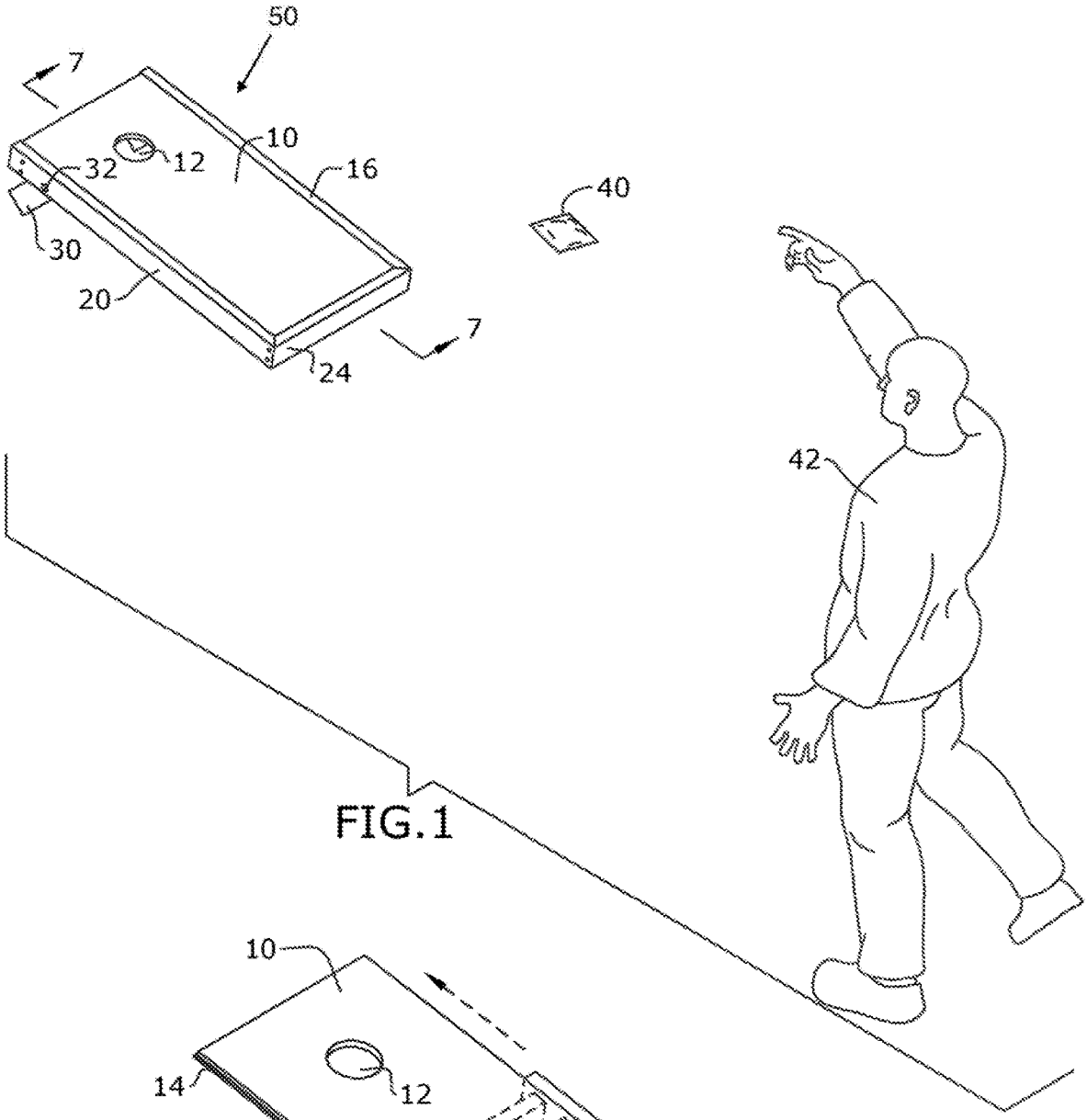
FIG. 1 is a perspective view of an embodiment of the present invention, shown in use.
Figure 2:
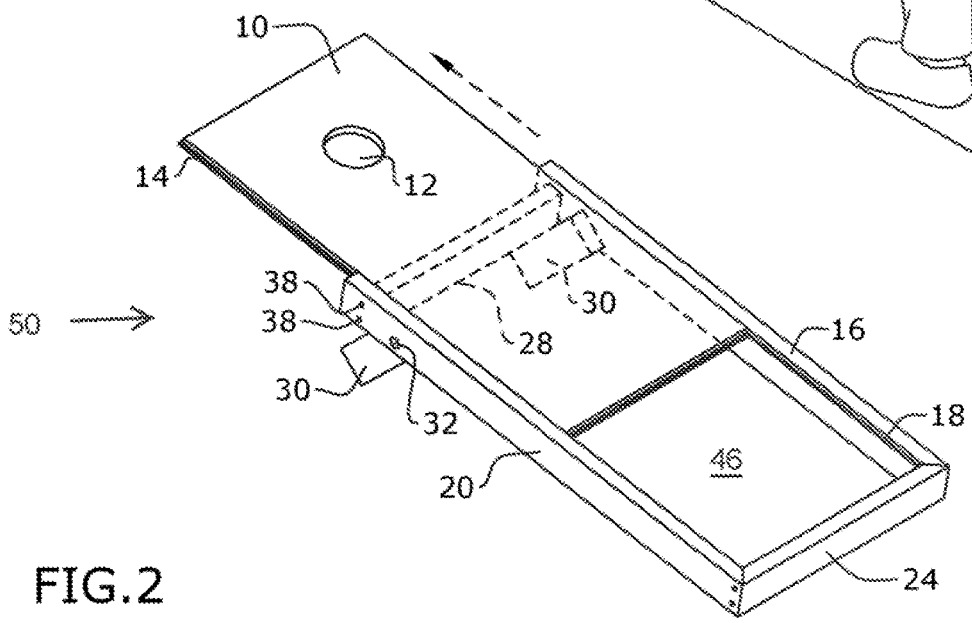
FIG. 2 is a perspective view of an embodiment of the present invention, illustrating a faceplate being removed.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises", and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

Broadly, an embodiment of the present invention may include a cornhole game board providing an interchangeable faceplate display. The game board includes a framework having a plurality of peripheral elements defining an opening into which a faceplate may be inserted. Each peripheral element may define a portion of a coplanar slot extending along the game board framework, wherein one of the plurality of faceplates may be slidably received or removed in the resulting coplanar slot thereby providing a variety of interchangeable playing surfaces of cornhole.

Referring now to FIGS. 1 through 10, the present invention may include a cornhole game board 50 providing interchangeable faceplate 10 capabilities. The game board 50 may provide a framework 48 having a plurality of peripheral elements defining an opening 46 into which one of a plurality of faceplates 10 may be inserted. The plurality of peripheral elements may include a pair of opposing longitudinal elements 16, 20 and a base element 24 interconnecting opposing ends of the longitudinal elements 24, 20. The base element 24 and the longitudinal elements 24, 20 may be contiguous to each other so as to define a substantially coplanar peripheral inner edge 19 defining the opening 46. The plurality of peripheral elements may be made of cardboard, plastic, wood, various fibrous materials or the like.

In certain embodiments, the plurality of peripheral elements may include a top element 28 interconnected to the opposing longitudinal elements 24, 20 on an end opposing the base element 24. The top element 28 may be adapted to provide lateral support for the opposing longitudinal elements 24, 20. The interconnections of the plurality of peripheral elements may be done by way of fasteners 38. The plurality of peripheral elements may form a parallelogram shape, as illustrated in the Figures, however any shape that functions in accordance with the disclosure herein is also sufficient.

Each peripheral element may define a portion of a coplanar slot 18, 22, 26 extending approximately the entire length of a periphery of the opening 46, as illustrated in FIGS. 9 and 10. The portions of the coplanar slot 18, 22, 26 in their totality provide a coplanar slot or groove for slidably receiving at least one faceplate 10. In certain embodiments, the coplanar slot may be formed by portions 18, 22 of the opposing longitudinal elements 24, 20. The resulting coplanar slot may be adapted so that each faceplate 10 can be slidably received so as to be visible through the opening 46. The top element 28 may be disposed downward (relative to the supporting surface 44) from the peripheral inner edge 19 so that the faceplate 10 slides over the top element 28.

The faceplate 10 may provide a peripheral dado 14 to facilitate the sliding reception within the coplanar slot. The faceplate 10 may have a design, messages, imagery or the like that a user 42 may wish to display, for example of a logo of the user's favorite sports team. The faceplate 10 may form at least one cornhole 12. In certain embodiments, the at least one cornhole 12 may be adapted to receive at least one corn bag 40 thrown by the user 42 when playing the cornhole game, as illustrated in FIG. 1.

Figure 3:
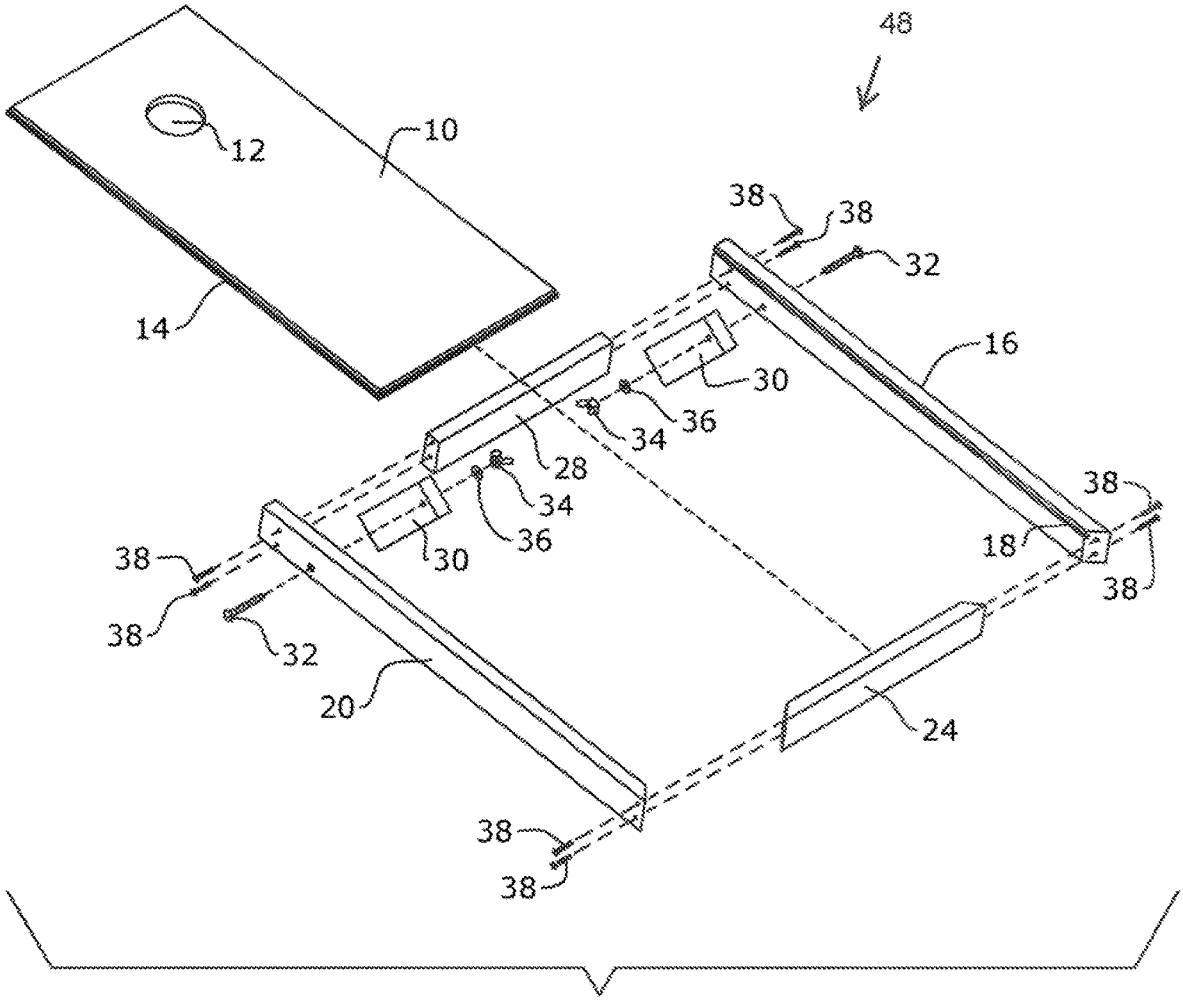
FIG. 3 is an exploded view of an embodiment of the present invention.
Figure 4:
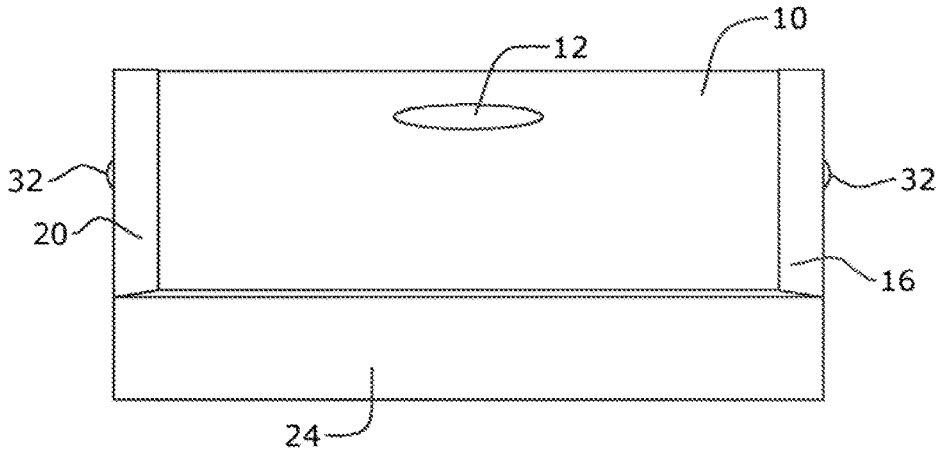
FIG. 4 is a front elevation view of an embodiment of the present invention.
Figure 5:
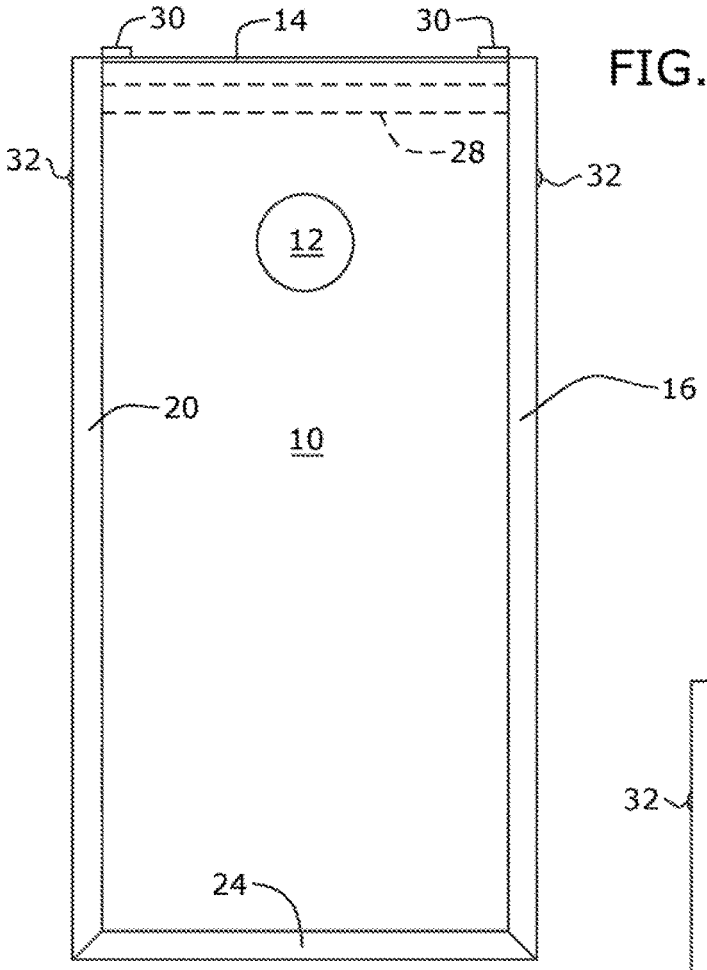
FIG. 5 is a top plan view of an embodiment of the present invention.
Figure 6:
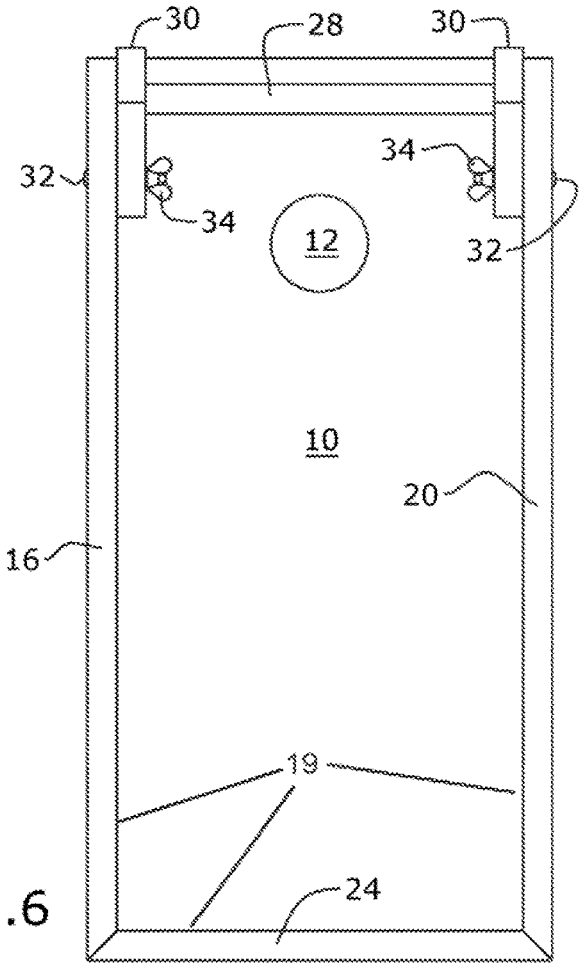
FIG. 6 is a bottom plan view of an embodiment of the present invention.
Figure 11A:
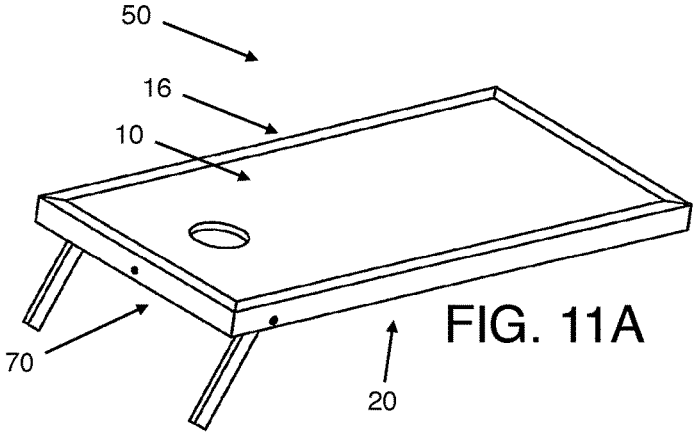
FIG. 11A-G are views of another embodiment of the present invention having a removable top component.
Figure 11B:
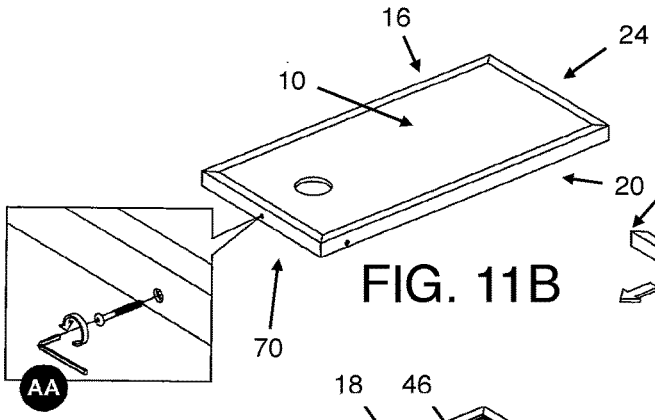
Figure 11C:
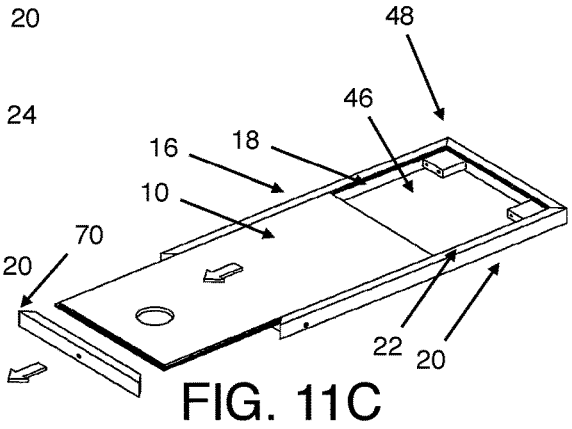
Figure 11D:
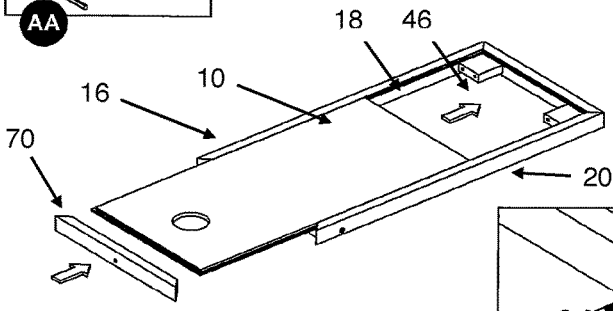
Figure 11E:
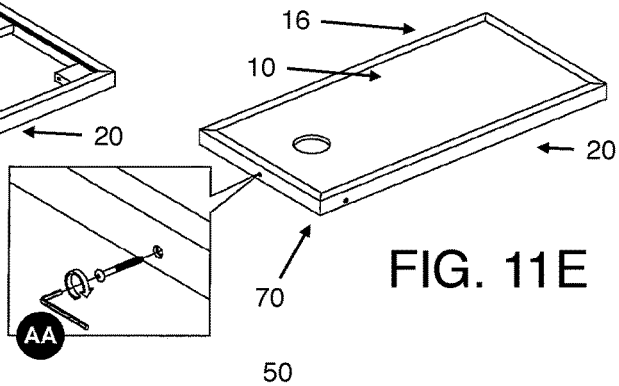
Figure 11F:
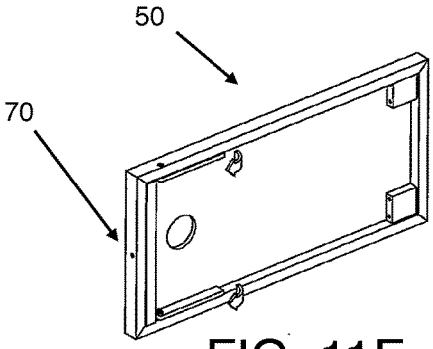
Figure 11G:
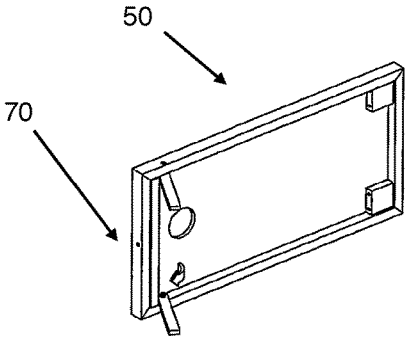

The framework 48 may include a leg 30 connected to each of the pair of the opposing longitudinal elements 16, 20 so as to prop up one end of the framework 48 so that the faceplate 10 is oriented at an acute angle relative to a ground surface 44 supporting the framework 48, as illustrated in FIG. 7. Each leg 30 may be connected to each longitudinal/peripheral element 16, 20 by way of fasteners 32, 34, 36, so as to be pivotally connected thereto, as illustrated in FIG. 3. The leg(s) 30 may be alternatively attached to the top element 28.

A method of making the present invention may include the following. An individual may provide equipment comprising two 48" 2×4's, two 24" 2×4's, and a 23"×46" piece of plywood. It may also be necessary to have a dado blade to make the cuts forming the coplanar slot or portions thereof. The initial step may include cutting the two 48" pieces of 2×4 and two 24" pieces of 2×4. Then the individual may then run a ⅝" dado cut, ¼" from the top of the 2×4's, along the inside of every piece of wood at a depth of ¾". The individual may then screw the 48" pieces to one of the 24" pieces to make a "U" shape with the dado cuts lining up. A 21" piece of 2×4 may be installed at the open end of the "U" so create the framework 48. To make a faceplate 10, the individual may then take a 19/32" thick piece of plywood and cut it to measure 23"×46". You must run a ⅝" dado at ¼" deep along the inside perimeter of the plywood. You will be able to insert the faceplate 10 into the framework 48 by sliding it in the top of the "U".

In certain embodiments, the individual may manufacture the interchangeable faceplate display 10 by the following:

Cut four (4) 2×4's into a 4' piece;

Cut four (4) 2×4's into a 2' piece;

Run a ⅝ dado cut;

Cut a 45 degree angle on opposite ends of the pieces of wood;

Screw two (2) of the 4' pieces to one of the 2' pieces, with the dado cut up;

Screw a 21" piece of 2×4;

Cut a 21 piece of 2×4;

Run a ⅝ dado cut;

Measure 9;

Slide in plywood to the frame;

Drill a ½;

Insert a 4' piece;

Cut a (2) two 10.5;

Drill a ¼;

Slide 10.5;

Slide the last 2' piece onto the top of the set;

Drill a ¼; and

Run a 6

A method of using the present invention may include the following. The cornhole game board 50 disclosed above may be provided. A user may slide a first faceplate 10 into the coplanar slots 18, 22 provided by the framework 48 so as to display the first faceplate 10 through the opening 46. Then, when the user wants a different display, the user may slidably remove the first faceplate 10 so as to exchange it with a second faceplate 10, whereby the second faceplate 10 is slidably received in the coplanar slots 18, 22. Then the user may play the game cornhole.

In one or more non-limiting embodiment as illustrated in FIG. 11, game board 50 may have a removable top element 70 configured to connect to coplanar slots 18, 22 provided by each of two longitudinal elements 24, 20, wherein removable top 70 may be configured to prevent the movement of said faceplates when slid into the longitudinal slots.

A method of using the embodiment as illustrated in FIG. 11, may include the following. The cornhole game board 50 disclosed may be provided. A user may slide a first faceplate 10 into the coplanar slots 18, 22 provided by the framework 48 so as to display the first faceplate 10 through the opening 46. User 42 may then connect removable top 70 to coplanar slots 18, 22 provided by each of the two longitudinal elements 16, 20 wherein said removable top 70 may then be fastened to coplanar slots 18, 22 to prevent the movement of first faceplate 10. Then, when the user wants a different faceplate, the user may unfasten and remove removable top 70 wherein then user may slidably remove first faceplate 10 so as to exchange it with a second faceplate 10, whereby the second faceplate 10 is slidably received in the coplanar slots 18, 20. Then user may replace and fasten removable top 70 to coplanar slots 18, 22. User may then play the game cornhole.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A gameboard, comprising:

two spaced apart longitudinal elements, said two spaced apart longitudinal elements each having a vertex at a first end of both longitudinal elements;

a base element comprising two ends each having a vertex that are obliquely opposed to both longitudinal element's first ends, said obliquely opposed vertexes interconnecting the two longitudinal elements so as to define an opening, wherein the two base element ends are each independently connected near the respective first ends of each of the two longitudinal elements as to form two obliquely opposed vertex connections;

a longitudinal slot provided by each of the two longitudinal elements so that the longitudinal slots are coplanar;

a removable component configured to connect to the longitudinal slot provided by each of the two longitudinal elements, wherein said removable component is configured to prevent the movement of said faceplates when slid into the longitudinal slots;

a plurality of faceplates, each of said faceplates having at least one cornhole that passes from a top surface to a bottom surface and each of said faceplates dimensioned and adapted with a dado along a first and a second side to slide into the longitudinal slots so as to be substantially visible through the opening, wherein said dado is configured to facilitate the sliding reception within the coplanar slots of said plurality of faceplates having at least one cornhole.

2. The gameboard of claim 1, further comprising: a leg provided by each of said two longitudinal elements configured for propping up a respective second end of each of the two longitudinal elements off of a ground surface.

3. The gameboard of claim 2, further comprising: at least one corn bag, wherein said at least one cornhole provided by each plurality of faceplates are configured to allow passage of said at least one corn bag from said top surface to said ground surface.

4. The gameboard of claim 3, further comprising a base slot provided by the base element so that the base slot is coplanar with the longitudinal slots.

5. The gameboard of claim 4, the two spaced apart longitudinal elements each having a 45-degree vertex at the first end of both longitudinal elements.

6. The gameboard of claim 5, the two ends of the base end each having a 45-degree vertex.

7. The gameboard of claim 5, the gameboard comprised of wood.

8. The gameboard of claim 5, the gameboard comprised of plastic.

9. A gameboard, comprising:

two spaced apart longitudinal elements, said two spaced apart longitudinal elements each having a 45 degree vertex at a first end of both longitudinal elements;

a base element comprising two ends each having a 45 degree vertex that are obliquely opposed to both longitudinal element's first ends, said obliquely opposed vertexes interconnecting the two longitudinal elements so as to define an opening, wherein the base elements two ends are each independently connected near the respective first ends of each of the two longitudinal elements as to form two obliquely opposed vertex connections;

a longitudinal slot provided by each of the two longitudinal elements so that the longitudinal slots are coplanar;

a removable component configured to connect to the longitudinal slot provided by each of the two longitudinal elements, wherein said removable component is configured to prevent the movement of said faceplates when slid into the longitudinal slots;

a plurality of faceplates, each of said faceplates having at least one cornhole that passes from a top surface to a bottom surface and each of said faceplates dimensioned and adapted with a dado along a first and a second side to slide into the longitudinal slots so as to be substantially visible through the opening, wherein said dado is configured to facilitate the sliding reception within the coplanar slots of said plurality of faceplates having at least one cornhole.

10. The gameboard of claim 9, further comprising a base slot provided by the base element so that the base slot is coplanar with the longitudinal slots.

11. The gameboard of claim 9, further comprising: at least one corn bag, wherein said at least one cornhole provided by each plurality of faceplates are configured to allow passage of said at least one corn bag from said top surface to a ground surface.

12. The gameboard of claim 11, further comprising: a leg provided by each of said two longitudinal elements configured for propping up a respective second end of each of the two longitudinal elements off of the ground surface.

13. The gameboard of claim 5, the gameboard comprised of wood.

14. The gameboard of claim 5, the gameboard comprised of plastic.

15. A method of changing a faceplate for a gameboard, the method comprising:

sliding a first faceplate into two spaced apart longitudinal slots, said two spaced apart longitudinal elements each having a vertex at a first end of both longitudinal elements, wherein the first faceplate visible through an opening in the framework, the framework comprising a base element comprising two ends each having a vertex that are obliquely opposed to both longitudinal element's first ends, said obliquely opposed vertexes interconnecting the two longitudinal elements so as to define an opening, wherein the base elements two ends are each independently connected near the respective first ends of each of the two longitudinal elements as to form two obliquely opposed vertexes connections, a longitudinal slot provided by each of the two longitudinal elements so that the longitudinal slots are coplanar, a removable component configured to connect to the longitudinal slot provided by each of the two longitudinal elements; and connecting removable component to the longitudinal slot provided by each of the two longitudinal elements, wherein said removable component prevents the movement of the first faceplate.

16. The method of claim 15, further comprising: removing removable component from the longitudinal slot provided by each of the two longitudinal elements.

17. The method of claim 16, further comprising: sliding the first faceplate out from the two spaced apart longitudinal slots.

18. The method of claim 17, further comprising: sliding a second faceplate into the two spaced apart longitudinal slots.

19. The method of claim 18, further comprising: connecting removable component to the longitudinal slot provided by each of the two longitudinal elements, wherein said removable component prevents the movement of the second faceplate.

20. The method of claim 15, the framework further comprising at least one corn bag, wherein said at least one cornhole provided by each plurality of faceplates are configured to allow passage of said at least one corn bag from said top surface to a ground surface, a base slot provided by the base element so that the base slot is coplanar with the longitudinal slots, two spaced apart longitudinal elements each having a 45-degree vertex at the first end of both longitudinal elements, the two ends of the base end each having a 45-degree vertex.

* * * * *